US007802875B2

(12) United States Patent
Miura et al.

(10) Patent No.: US 7,802,875 B2
(45) Date of Patent: Sep. 28, 2010

(54) LIQUID EJECTION HEAD AND RECORDING APPARATUS

(75) Inventors: Kaoru Miura, Matsudo (JP); Koichi Kitakami, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 12/167,652

(22) Filed: Jul. 3, 2008

(65) Prior Publication Data

US 2009/0021562 A1 Jan. 22, 2009

(30) Foreign Application Priority Data

Jul. 6, 2007 (JP) ..... 2007-178286

(51) Int. Cl.
*B41J 2/045* (2006.01)

(52) U.S. Cl. ..... 347/68

(58) Field of Classification Search ..... 347/68, 347/65, 69–72; 400/124.14, 124.16; 310/311, 310/324

See application file for complete search history.

(56) References Cited

U.S. PATENT DOCUMENTS 6,488,355 B2 12/2002 Nakamura et al.
7,121,650 B2 * 10/2006 Chung et al. ..... 347/68
7,338,151 B1 * 3/2008 Samura ..... 347/70
7,585,061 B2 * 9/2009 Mita ..... 347/70
2008/0239016 A1 10/2008 Miura

FOREIGN PATENT DOCUMENTS

JP 2000-158645 6/2000
JP 2001-334661 12/2001
JP 3666386 4/2005

* cited by examiner

*Primary Examiner*—K. Feggins
(74) *Attorney, Agent, or Firm*—Fitzpatrick, Cella, Harper & Scinto

(57) ABSTRACT

An ink jet recording head includes a plurality of ejection outlets for ejecting liquid; individual liquid chambers communicating with the plurality of ejection outlets; ejection energy generating elements, provided correspondingly to associated ones of the individual liquid chambers, for generating energy for ejecting the liquid; a common liquid chamber for supplying the liquid to the plurality of individual liquid chambers; and communicating paths constituting flow paths for communicating associated ones of the individual liquid chambers and the common liquid chamber with each other. At least adjacent ones of the flow paths have communicating positions, at different portions as seen in a direction perpendicular to a direction of ejection of the liquid through the ejection outlets, with said common liquid chamber.

9 Claims, 12 Drawing Sheets

(a)

(b)

(a)

(b)

(c)

LIQUID EJECTION HEAD AND RECORDING APPARATUS

FIELD OF THE INVENTION AND RELATED ART

The present invention relates to a liquid ejection head for ejecting liquid such as ink onto a recording material such as a recording sheet or the like and relates to a recording apparatus including the liquid ejection head.

The liquid ejection head is employed in a recording apparatus used as an image forming apparatus such as a printer or the like. This liquid ejection head includes ejection outlets for ejecting liquid, individual liquid chambers connected to the ejection outlets through orifice communicating paths, and ejection energy generating means for generating energy for ejecting the liquid in the individual liquid chambers. The liquid ejection head ejects the liquid from the ejection outlets through the orifice communicating paths by expansion and contraction of the liquid in the individual liquid chambers.

The liquid ejection head of this type includes a piezoelectric type liquid ejection head in which an electromechanical transducer element such as a piezoelectric element or the like is used to dispose a vibrational plate forming a wall surface of an individual liquid chamber thereby to eject the liquid. In addition, there are also known a thermal type liquid ejection head in which a bubble is generated by film boiling of ink by a heat generating resistor or the like disposed in an individual liquid chamber to eject an ink droplet and an electrostatic type liquid ejection head in which a vibrational plate is displaced by an electrostatic force to eject the liquid.

Each of the individual liquid chambers of the liquid ejection heads is connected to a common liquid chamber via a communicating path (common liquid chamber communicating path) constituting a flow path. In the liquid ejection heads, sufficient liquid is supplied from the common liquid chamber to each of the individual liquid chambers through the common liquid chamber communicating path.

When the liquid in the individual liquid chamber is ejected from the ejection outlet, there arises a so-called cross-talk problem such that a part of the liquid present in the individual liquid chamber flows backward into the common liquid chamber by the influence of a pressure during the ink ejection to adversely affect an ejecting operation in another individual liquid chamber through the common liquid chamber. In the individual liquid chamber adversely affected by the cross-talk, it can be difficult to perform a stable ejecting operation with an ejection amount of the liquid kept at a constant level.

A conventional liquid ejection head is principally intended to realize high density, not to prevent the cross-talk, but such a structure that a certain effect on the cross-talk might be achieved is disclosed (Japanese Patent (JP-B) 3666386). As shown in FIGS. 12(*a*) to 12(*c*) and FIGS. 13(*a*) and 13(*b*), the structure disclosed in JP-B 3666386 includes individual liquid chambers 201 classified into a plurality of groups connected to different common liquid chambers 202, respectively. Each individual liquid chamber 201 is provided with a supply port through which ink is supplied from an associated common liquid chamber 202 and an ejection outlet 205 for ejecting the ink supplied from the supply port 203. Particularly, Japanese Laid-Open Patent Application (JP-A) 2001-334661 discloses that individual liquid chambers 201 are classified into a plurality of groups, with a length (flow path length) of a common liquid chamber communicating path 206, connected to different common liquid chambers 202, respectively. With the structure disclosed in JP-B 3666386, it is inferred that the influence of the cross-talk on portions among the individual liquid chambers 201 connected to the different common liquid chambers 202 is small.

On the other hand, in another conventional liquid ejection head, such a structure that all the individual liquid chambers 201 communicate with one large common liquid chamber 202 is disclosed (JP-A 2000-158745). In this structure, as shown in FIGS. 14(*a*) to 14(*c*), even in the case where a part of liquid flows backward into the common liquid chamber 202 when the liquid is ejected from an arbitrary individual liquid chamber 201, the liquid which flowed backward extends isotropically in the large common liquid chamber 202, so that it is inferred that the structure achieves a certain effect with respect to the cross-talk.

The structure disclosed in JP-B 3666386 is adaptable to a high recording density of about 600 dpi or more and is less affected by the cross-talk between the individual liquid chambers connected to different common liquid chambers. However, even in such a constitution, between the individual liquid chambers connected to the same common liquid chamber, there is a large influence of the cross-talk. Particularly, with respect to adjacent individual liquid chambers, there is considerable influence of the cross-talk during a continuous ejection operation.

Further, in the constitution of JP-A 2000-158645, when the ejecting operation is continued, it is inferred that it is difficult to keep an ejection amount of liquid at a constant level and carry out a stable ejecting operation.

SUMMARY OF THE INVENTION

A principal object of the present invention is to provide a liquid ejection head capable of alleviating an influence of cross-talk on adjacent individual liquid chambers of individual liquid chambers which are connected to a single (the same) common liquid chamber and arranged with a high density and capable of performing an ejecting operation while stably retaining an ejection amount.

According to an aspect of the present invention, there is provided an ink jet recording head comprising:

a plurality of ejection outlets for ejecting liquid;

individual liquid chambers communicating with the plurality of ejection outlets;

ejection energy generating elements, provided correspondingly to associated ones of the individual liquid chambers, for generating energy for ejecting the liquid;

a common liquid chamber for supplying the liquid to the plurality of individual liquid chambers; and communicating paths constituting flow paths for communicating associated ones of the individual liquid chambers and the common liquid chamber with each other, wherein at least adjacent ones of the flow paths have communicating positions, at different portions as seen in a direction perpendicular to a direction of ejection of the liquid through the ejection outlets, with said common liquid chamber.

According to the present invention, it is possible to considerably alleviate the influence of the cross-talk and reduce a variation in the ejection amount of the liquid to realize the stable ejecting operation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described below with reference to the drawings.

First Embodiment

First Embodiment of the present invention will be described with reference to FIGS. 1 to 5.

Figure 1:
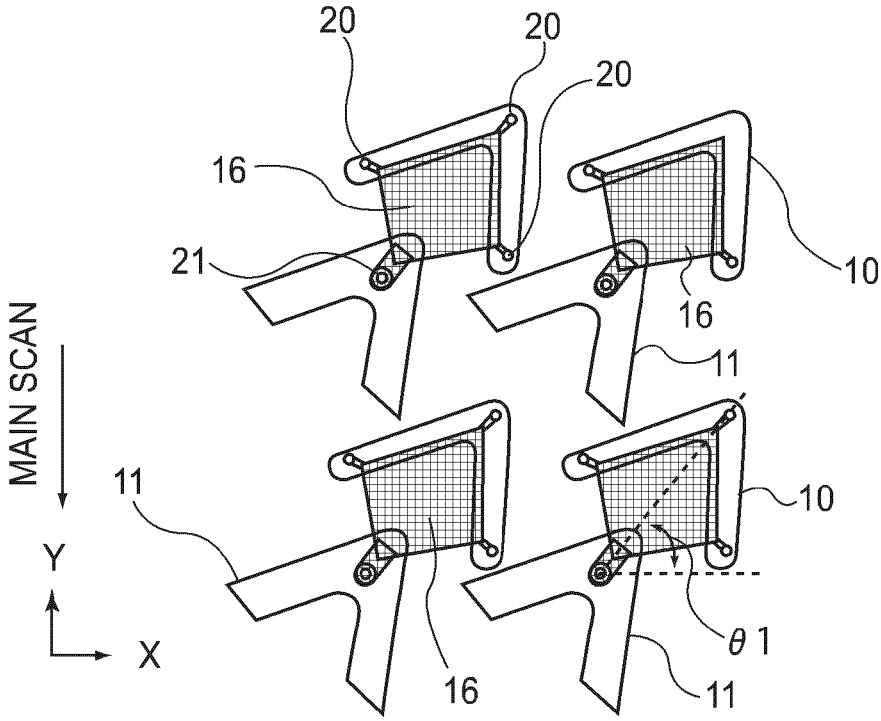
FIG. 1 is a plan view showing a principal portion of a liquid ejection head according to First Embodiment.

FIG. 1 is a plan view showing a principal portion of a liquid ejection head of this embodiment. As shown in FIG. 1, the liquid ejection head of this embodiment includes ejection outlets 21 for ejecting ink as liquid, individual liquid chambers 16 communicating with the ejection outlets 21, and a vibrational plate as an ejection energy generating means for generating energy for ejecting the liquid by expansion and contraction of the liquid in each individual liquid chamber 16. The liquid ejection head is provided with a plurality of arranged individual liquid chambers 16.

The liquid ejection head further includes a common liquid chamber 19 for supplying the liquid to the plurality of individual liquid chambers 16, an orifice communicating path 17 constituting a flow path for communicating an associated ejection outlet 21 and an associated individual liquid chamber 16 with each other, and a common liquid chamber communicating path 18 constituting a flow path for communicating the associated individual liquid chamber 16 and the common liquid chamber 19 with each other.

Each of the individual liquid chambers 16 is formed in a substantially rectangular (rhombus) cross sectional shape with four corners where an ejection outlet 21 and three supply ports 20 for supplying the liquid from the common liquid chamber 19 are disposed. Each of the individual liquid chambers 16 is provided with an orifice communicating path 17 connected to an ejection outlet 21 and three common liquid chamber communicating paths 18 connected to the three supply ports 20, respectively.

With respect to the orifice communicating path 17 and the common liquid chamber communicating paths 18, flow paths are constituted by an orifice communicating path column-like portion and a common liquid chamber projected portion 10, respectively, and are formed in a substantially V character-like, i.e., a so-called wedge-like, cross-sectional shape with respect to a direction perpendicular to an ejecting direction of the liquid. As shown in FIG. 1, the V cross-sectional common liquid chamber projected portion 10 and the V cross-sectional orifice communicating path column-like portion 11 are opened toward a front end portion of the liquid ejection head with respect to a main scan direction (a travelling direction of the liquid ejection head during ejection of the ink from each ejection outlet).

In this embodiment, each individual liquid chamber 4 has a dimension, e.g., such that a length of a diagonal line connecting an ejection outlet 21 with a supply port 20 located diagonally with respect to the ejection outlet 21 is 500 μm and a length of a diagonal line connecting other (two) supply ports 20 is 300 μm. An angle formed between the diagonal line connecting the ejection outlet 21 of the orifice communicating path 17 for the individual liquid chamber 16 with the supply port 20 located diagonally with respect to the ejection outlet 21 and a row (X-axis in FIG. 1) direction perpendicular to the main scan direction is taken as an individual liquid chamber angle θ1.

This individual liquid chamber angle θ1 is determined by directions of the above-described V cross-sectional common liquid chamber projected portion 10 and orifice communicating path column-like portion 11, an in-plane arrangement direction of each individual liquid chamber 16, and an arrangement angle θ2 described below.

Figure 2:
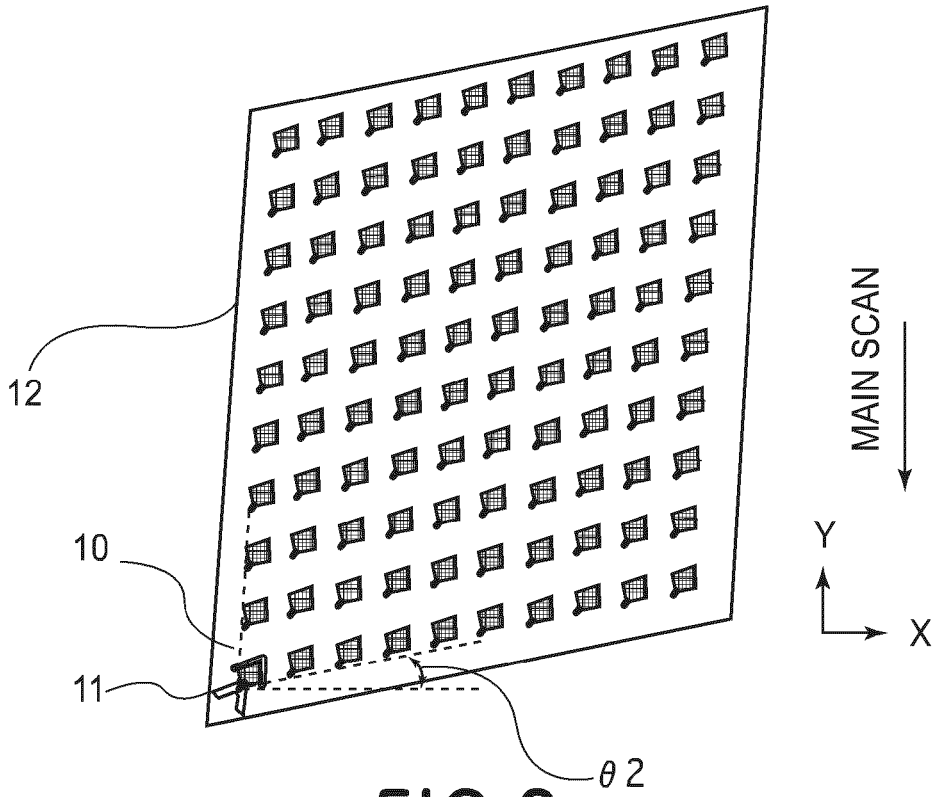
FIG. 2 is a plan view for illustrating the liquid ejection head.

FIG. 2 is a plan view showing the liquid ejection head of this embodiment, wherein 100 (10×10) individual liquid chambers 16 each having the shape shown in FIG. 1 are arranged in a plane. As shown in FIG. 2, the plurality of individual liquid chambers 16 is arranged in an area surrounded by a common liquid chamber partition wall 12.

Figure 3:
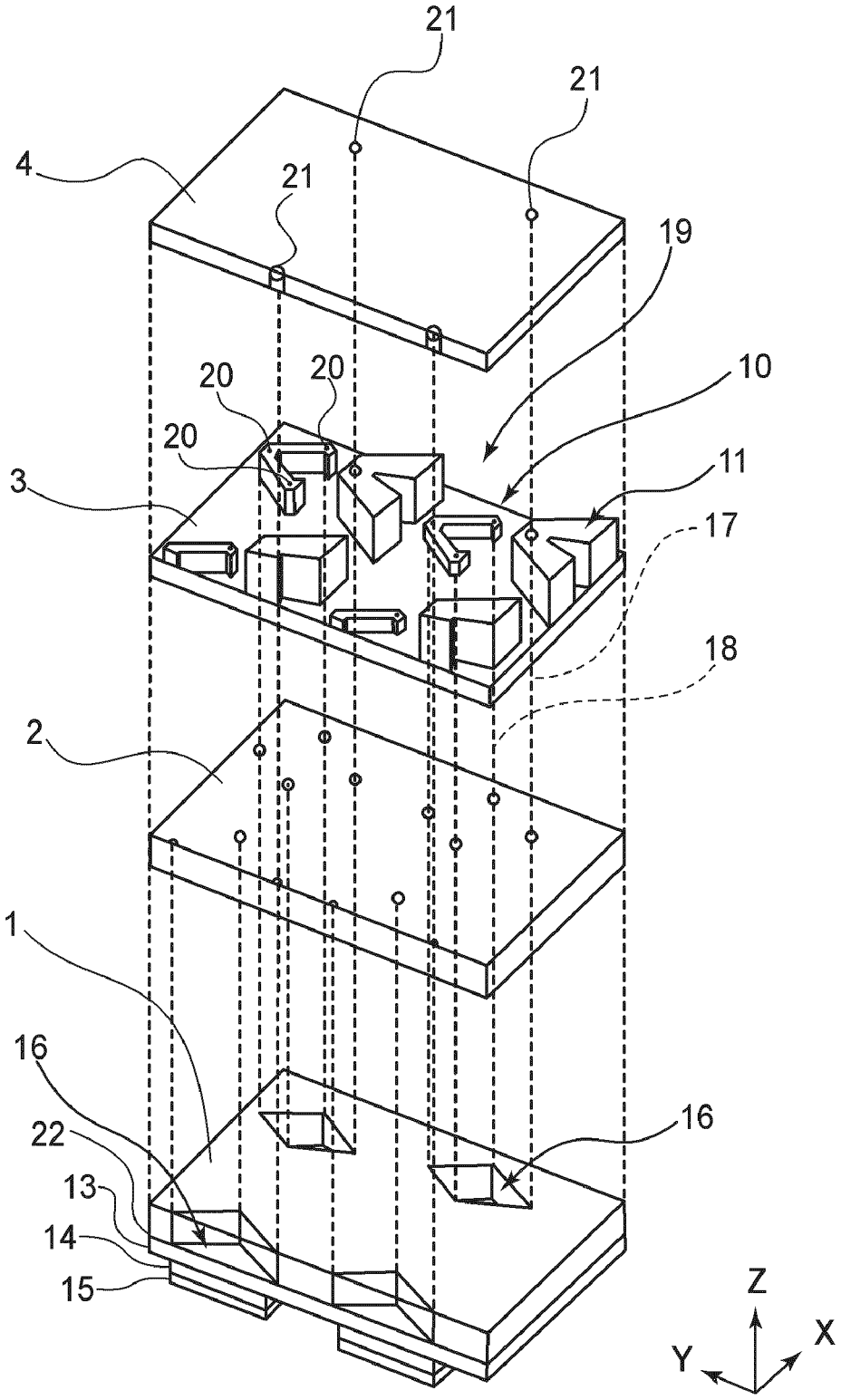
FIG. 3 is an exploded perspective view showing the liquid ejection head.

The liquid ejection head is provided with, as shown in FIG. 3, the common liquid chamber 19 on a layer on which the individual liquid chambers 16 are arranged. Referring again to FIG. 2, an angle formed by an arrangement direction of the ejection outlets 21 of the individual liquid chambers 16 arranged roughly along a row (X-axis in FIG. 2) direction perpendicular to the main scan direction and the X-axis is taken as the arrangement axis θ2.

When the influence of the cross-talk is taken into consideration, it is desirable that the individual liquid chambers 16 arranged roughly along the X-axis direction are disposed so that ejecting operations from adjacent individual liquid chambers 16 are not performed at the same time. Therefore, the arrangement angle θ2 may desirably be a non-zero finite value. Further, in order to achieve the high density of the ejection outlets, the ejection outlets 21 are arranged so that those arranged in a column (Y-axis) direction (FIG. 2) are shifted every column with respect to the row (X-axis) direction.

Figure 5:
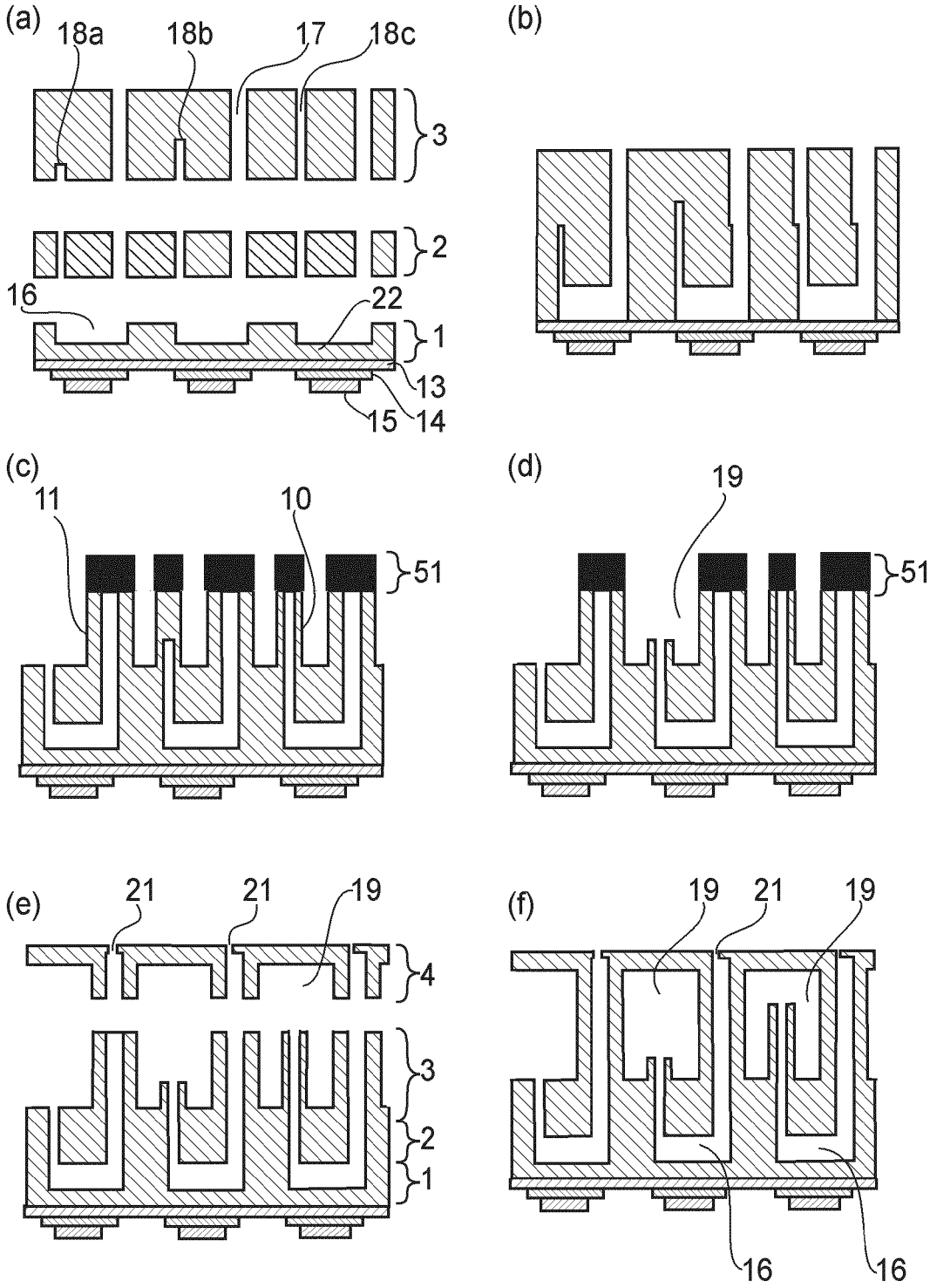
FIGS. 5(*a*) to 5(*f*) are sectional views for illustrating a production process of the liquid ejection head.

The liquid ejection head of this embodiment is prepared by applying four substrates (first to fourth substrates) to each other. FIG. 3 is a perspective view showing the liquid ejection head exploded into patterned four substrates. In an actual production process of the liquid ejection head, as shown in FIGS. 5(*a*) to 5(*d*), a substrate 3 may desirably be subjected to patterning after a substrate 2 and the substrate 3 are bonded to each other. This is because a sufficient mechanical strength can be obtained by the bonding between the substrates 2 and 3.

Figure 4:
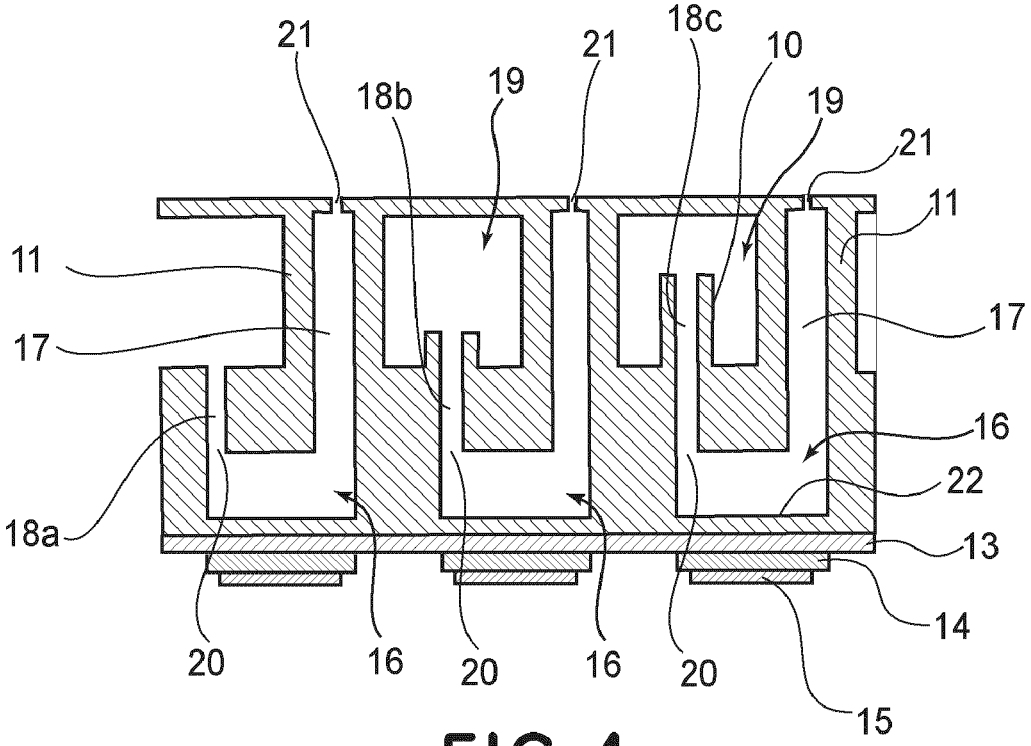
FIG. 4 is a sectional view showing the liquid ejection head.

FIG. 4 is a sectional view showing a constitution in which flow path lengths of the common liquid chamber communicating paths 18 with respect to adjacent three individual liquid chambers 16 are different from each other. Referring to FIG. 4, three flow paths constituted by three common liquid chamber communicating paths 18*a*, 18*b* and 18*c* have communicating positions, at different portions as seen in a direction perpendicular to a direction of ejection of the liquid through the ejection outlets 21, with the common liquid chamber 19. That is, as shown in FIG. 4, the adjacent three individual liquid chambers 16 are provided with three common liquid chamber communicating paths 18*a*, 18*b* and 18*c*, respectively, different in flow path length for connecting the common liquid chamber 19 to an associated supply port 20. That is, as shown in FIGS. 3 and 4, to the same common liquid chamber 19, each of the common liquid chamber communicating paths 18*a*, 18*b* and 18*c* different in flow path length is connected. The individual liquid chambers 16 are classified into a plurality of groups associated with the common liquid chamber communicating paths different in flow path length.

A production process of the entire liquid ejection head of this embodiment will be described with reference to FIGS. 5(*a*) to 5(*f*).

First, as shown in FIG. 5(*a*), substrates 1, 2 and 3 of three types for patterning are prepared. As the substrates 1, 2 and 3, e.g., an Si substrate or an SOI substrate or the like is used but the SOI substrate may desirably be used in view of a patterning step described below. For example, each of the substrates 1 and 2 comprises a 200 μm-thick SOI substrate consisting of a 199.5 μm-thick silicon (Si) layer and a 0.5 μm-thick silicon oxide ($SiO_2$) layer. The substrate 3 comprises a 400 μm-thick SOI substrate consisting of a 399.5 μm-thick silicon (Si) layer and a 0.5 μm-thick silicon oxide ($SiO_2$) layer.

Next, patterning of the substrates 1, 2 and 3 is performed. The substrate 1 is subjected to patterning for the individual liquid chambers 16. At a bottom surface of the individual liquid chamber 16, a vibrational plate 22 of silicon (Si) is formed in a thickness of, e.g., 6 μm. Thereafter, e.g., a 0.3 μm-thick platinum (Pt) lower electrode 13, a 3.0 μm-thick lead zirconate titanate (PZT) piezoelectric film 14, and a 0.3 μm-thick platinum (Pt) upper electrode 15 are formed and used in combination with the vibrational plate 22 as an expansion and contraction means for the individual liquid chamber 16.

The substrate 2 is subjected to patterning of an orifice communicating path 17 with a diameter of 60 μm and three common liquid chamber communicating paths 18*a*, 18*b* and 18*c* each with a diameter of 10 μm. The substrate 3 is subjected to patterning of the orifice communicating path 17 and the common liquid chambers 18*a*, 18*b* and 18*c* different in length from each other. These patterning operations are performed by, e.g., chemical etching or ion milling. After the patterning operations of the substrates 1, 2 and 3, each of the substrates 1, 2 and 3 is subjected to a flattening process.

Next, as shown in FIG. 5(*b*), bonding of the substrate 1, 2 and 3 is carried out. In this case, bonding between the substrates 2 and 3 which are the SOI substrates is performed so that the silicon oxide ($SiO_2$) layers are located as the upper layer of the substrate 2 and the lower layer of the substrate 3. This is because, as described later with reference to FIGS. 5(*c*) and 5(*d*), the silicon oxide ($SiO_2$) film has a function of arresting the progression of the patterning when the common liquid chamber projected portion 10 associated with the common liquid chamber communicating path 18*b* is processed. Further, the bonding of the substrates 1, 2 and 3 is carried out with gold (Au)-gold (Au) bonding.

Then, as shown in FIGS. 5(*c*) and 5(*d*), the patterning of the common liquid chamber 19 is performed in two steps.

First, as a first step, the patterning of the common liquid chamber 19 is performed in an area other than those for the orifice communicating path 17 and the common liquid chamber communicating paths 18*b* and 18*c*. This patterning is effected by chemical etching or ion milling. FIG. 5(*c*) shows a process for performing the patterning through the chemical etching and shows a state immediately after the chemical etching is effected. Thereafter, a resist 51 is removed.

Next, as shown in FIG. 5(*d*), a second step of the patterning of the common liquid chamber 19 is performed. In this step, patterning is performed in an area of an upper portion of the common liquid chamber communicating path 18. This patterning is carried out by the chemical etching or the ion milling. FIG. 5(*d*) shows a process for performing the patterning through the chemical etching and shows a state immediately after the resist 51 is applied and the chemical etching is performed. By this chemical etching, the upper portion of the common liquid chamber communicating path 18*b* is patterned. On the other hand, at the portion of the common liquid chamber 19 which has already been subjected to the patterning through the chemical etching in the step shown in FIG. 5(*c*), further progression of the etching is arrested. After the patterning, the resist 51 is removed and then flattening process of the substrate 3 is performed.

Next, as shown in FIG. 5(*e*), the substrate 4 for patterning is prepared. As the substrate 4, e.g., an Si substrate or an SOI substrate or the like is used, but the SOI substrate may desirably be used from the viewpoint of the patterning. The substrate 4 may, e.g., comprise a 200 μm-thick SOI substrate consisting of a 199.5 μm-thick Si layer and a 0.5 μm-thick SiO2 layer. Next, the substrate 4 is subjected to patterning of the orifice communicating path 17, the common liquid chamber 19, and ejection outlets 21 with, e.g., a diameter of 30 μm and a height of 50 μm. This patterning is performed through, e.g., the chemical etching or ion milling. After the patterning, a flattening process of the substrate 4 is performed.

Finally, as shown in FIG. 5(*f*), bonding between the substrate 3 and the substrate 4 is effected. The bonding is effected through, e.g., gold (Au)-gold (Au) bonding. In this step, the substrates 1, 2, 3 and 4 are integrated.

As described above, the individual liquid chambers 16 in the liquid ejection head of this embodiment are classified into the plurality of groups in which the flow path lengths of the common liquid chamber communicating paths 18 are different from each other and the same common liquid chamber 19 is connected to the respective common liquid chamber communicating paths 18*a*, 18*b* and 18*c*. That is, the flow path lengths of the common liquid chamber communicating paths 18*a*, 18*b* and 18*c* each connected to the same common liquid chamber 19 are provided in a plurality of different lengths. In other words, communicating positions (openings) of the common liquid chamber communicating paths 18 in the common liquid chamber 19 are different with respect to a vertical direction. Particularly, it is preferable that adjacent common liquid chamber communicating paths 18 are different in height of the opening. For this reason, even in the case where a part of the liquid flows backward from an individual liquid chamber 16, from which the liquid is ejected, into the common liquid chamber 19, the influence of the back-flow of the liquid through the common liquid chamber 19 on other individual liquid chambers 16 connected to the supply ports 20 from which the flow path lengths of the common liquid chamber communicating paths 18 are different from each other. Therefore, even in a structure in which the plurality of individual liquid chambers is arranged at a high density, the influence of the cross-talk can be alleviated, so that it is possible to keep the ejection amount of the liquid at a constant level to effect a stable ejecting operation.

Further, the liquid ejection head of this embodiment has the common liquid chamber communicating path projected portions 10 and the orifice communicating path column-like portions 11 which are formed in the substantially V character-like cross section opening toward the front end of the liquid ejection head with respect to the main scan direction. When the ejecting operation of the respective individual liquid chambers 16 in the liquid ejection head at the time of starting a recording operation on a recording material is considered, the ejecting operation is started from an ejection outlet 21 moved to a position in which the liquid is to be ejected. By this time difference of the start of the ejecting operation, flow of the liquid from the individual liquid chamber 16 with an earlier ejection time toward the common liquid chamber 19 adversely affects the ejecting operation from the individual liquid chamber 16 with a later ejection time. In the liquid ejection head of this embodiment, the order of the ejecting operation of the respective individual liquid chambers 16 substantially coincides with the position of the liquid ejection head in the main scan direction. That is, by spaces defined by the V cross-sectional common liquid chamber communicating path projected portions 10 and orifice communicating path column-like portions 11, the flow of the liquid in the common liquid chamber 19 generated by the back-flow from the individual liquid chamber 16 for immediately preceding ejection (or a distribution of pressure by formation of a high-pressure area) is suppressed. For this reason, the influence of the cross-talk can be further alleviated.

The liquid ejection head is provided with the plurality of common liquid chamber communicating paths 18 each connected to an associated individual liquid chamber 16. By providing the plurality of common liquid chamber communicating paths 18, the liquid is forcedly ejected during a refreshing operation of an ejection characteristic. As a result, it is possible to easily discharge a bubble entering or generated in the inside of the individual liquid chamber 16 to the outside of the liquid ejection head through the ejection outlet 21. Further, it is possible to sufficiently ensure supply of the liquid from the common liquid chamber 19 to the individual liquid chambers 16. Incidentally, the flow path lengths of the plurality of common liquid chamber communicating paths 18 connected to the same common liquid chamber 19 may be the same or different from each other.

Second Embodiment

Figure 6:
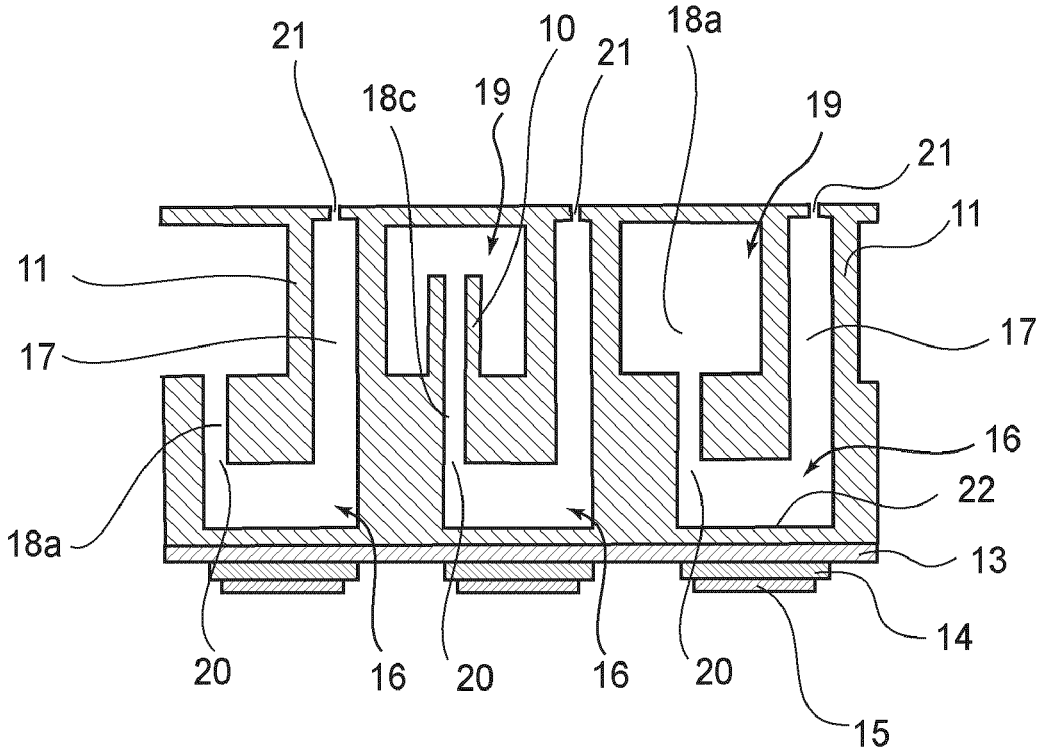
FIG. 6 is a sectional view showing a liquid ejection head according to Second Embodiment.

Next, Second Embodiment will be described with reference to FIG. 6 and FIGS. 7(*a*) to 7(*e*).

In First Embodiment, three types of the different flow path lengths are set with respect to the common liquid chamber communicating paths 18 connected to the same common liquid chamber 19. However, in this embodiment, as shown in FIG. 6, different from First Embodiment, two types of different flow path lengths with respect to common liquid chamber communicating paths 18 connected to the same common liquid chamber 19 are employed. It is preferable that at least heights of adjacent openings of the common liquid chamber communicating paths 18 communicating with the common liquid chamber 19 are different from each other. As described with reference to FIGS. 7(*a*) to 7(*e*) below, the number of types of the different flow path lengths of the common liquid chamber communicating paths 18 connected to the same common liquid chamber 19 is reduced to two, so that patterning of the common liquid chamber 19 can be carried out in one step to further facilitate a production step of the common liquid chamber 19.

Figure 7:
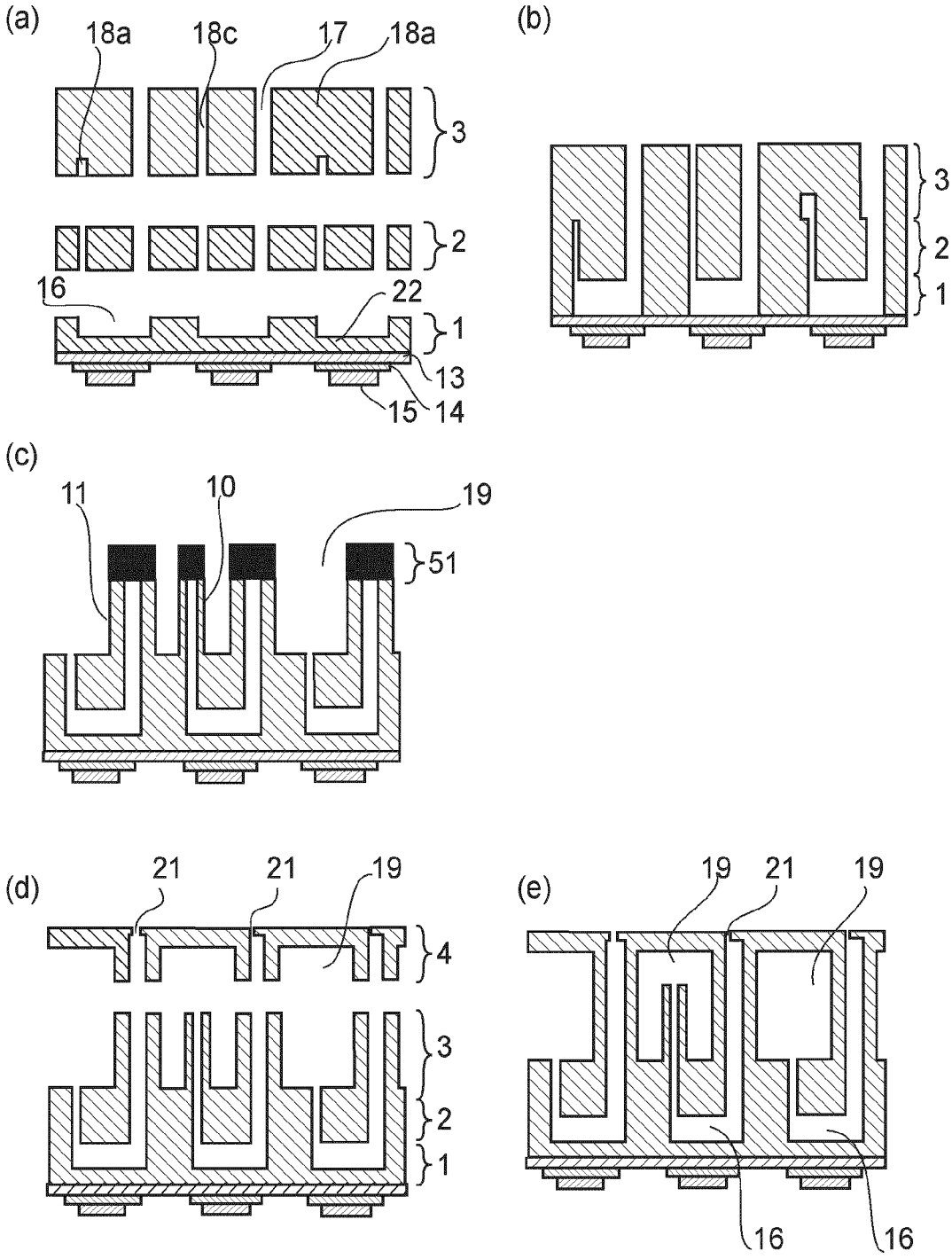
FIGS. 7(*a*) to 7(*e*) are sectional views for illustrating a production process of the liquid ejection head in Second Embodiment.

FIGS. 7(*a*) to 7(*e*) are sectional views for illustrating a production process of the entire liquid ejection head of this embodiment. A wafer and a processing method necessary to produce the liquid ejection head in this embodiment and those in First Embodiment are in common with each other in some steps. The steps shown in FIGS. 7(*a*) and 7(*b*) are identical to those shown in FIGS. 5(*a*) and 5(*b*), respectively. Patterned substrates 1, 2 and 3 are prepared and bonded to each other.

Next, as shown in FIG. 7(*c*), patterning of the common liquid chamber 19 is performed in an area other than those for the orifice communicating paths 17 and the common liquid chamber communicating path 18*c*. This patterning is effected through, e.g., the chemical etching or the ion milling. FIG. 7(*c*) shows a process for effecting through the chemical etching and shows a state immediately after the chemical etching. After the patterning, the resist 51 is removed and the substrate 3 is subjected to a flattening processing. Finally, as shown in FIG. 7(*d*), patterned substrate 4 is prepared and bonded to the substrate 3 through, e.g., gold (Au)-gold (Au) bonding to complete a structure as shown in FIG. 7(*e*). These steps shown in FIGS. 7(*d*) and 7(*e*) are identical to those shown in FIGS. 5(*e*) and 5(*f*) described above, respectively.

Third Embodiment

Third Embodiment will be described with reference to FIG. 8 and FIGS. 9(*a*) to 9(*i*). In this embodiment, different from First and Second Embodiments, the number of the substrates constituting the liquid ejection head is smaller than those in First and Second Embodiments by one. That is, the liquid ejection head is constituted by bonding three substrates to each other. Therefore, a production process is further easily performed compared with those in First and Second Embodiments.

Figure 8:
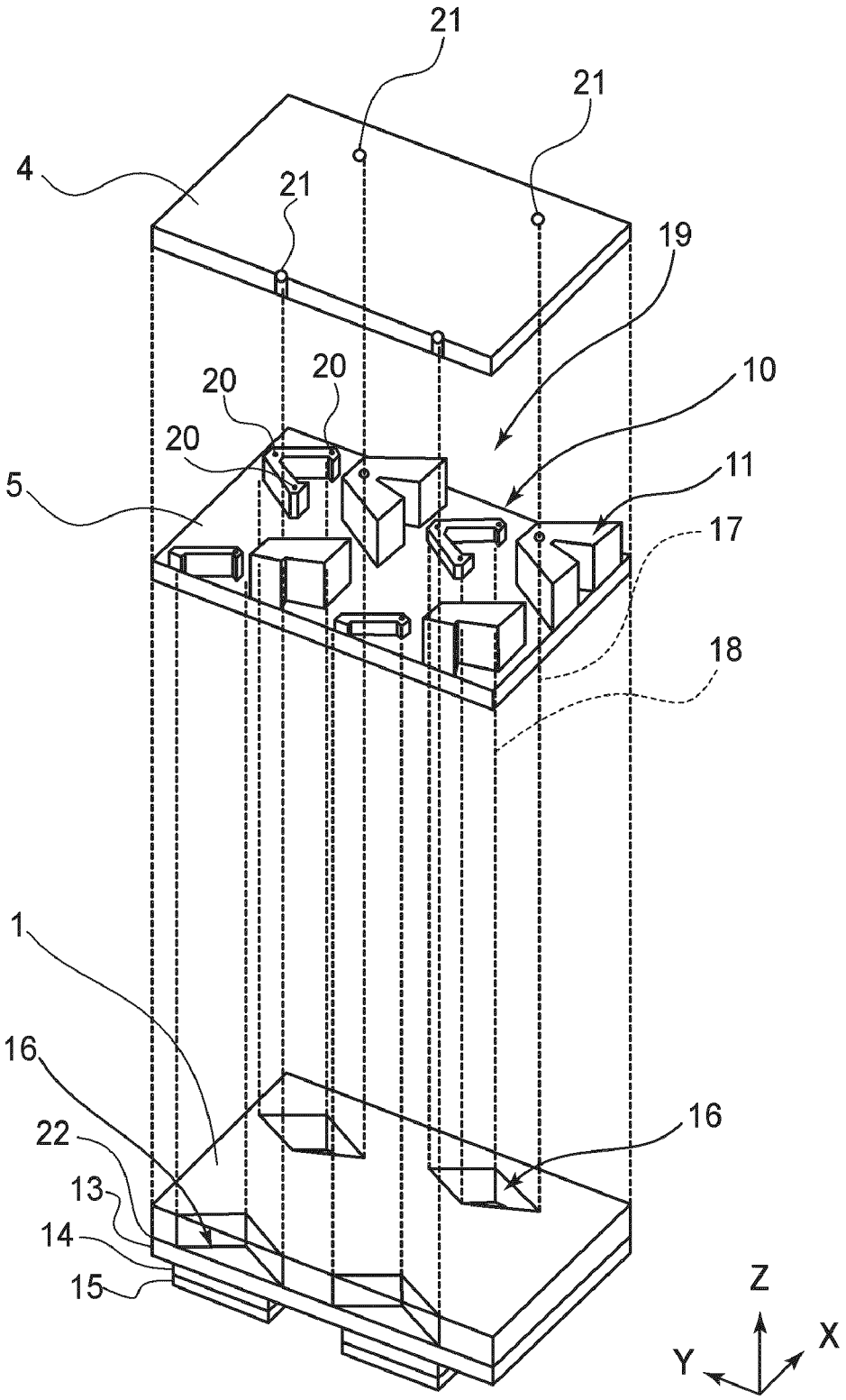
FIG. 8 is an exploded perspective view showing a liquid ejection head according to Third Embodiment.

FIG. 8 is a perspective view showing exploded and patterned through substrates for constituting the liquid ejection head of this embodiment, wherein the three substrates consisting of a substrate 1, a substrate 5 and a substrate 4 are bonded to each other to constitute the liquid ejection head. In this embodiment, different from First and Second Embodiments, the liquid ejection head is produced by bonding the substrate 1 and the substrate 4 to each other after the substrate 5 is subjected to patterning.

Figure 9:
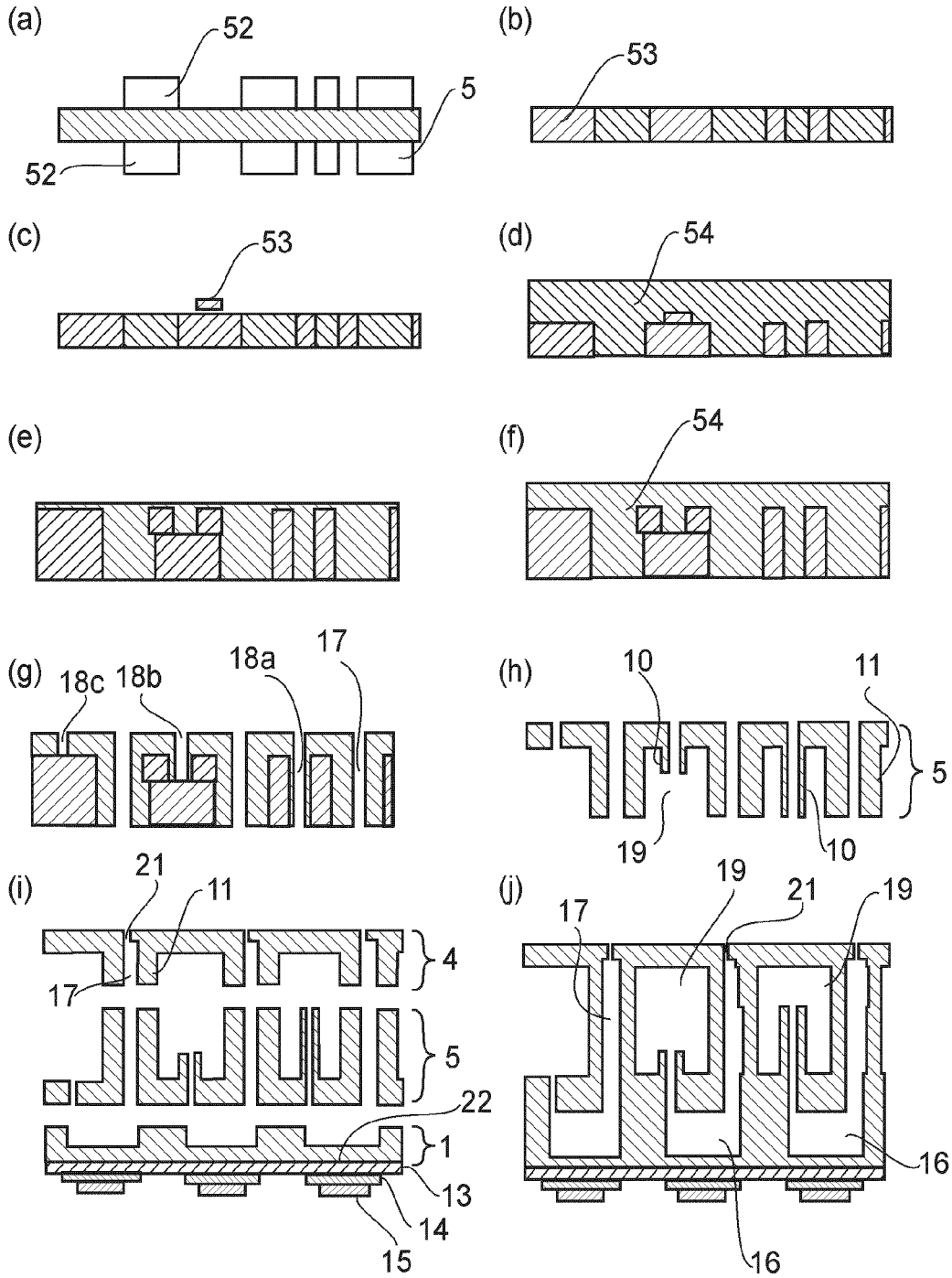
FIGS. 9(*a*) to 9(*j*) are sectional views for illustrating a production process of the liquid ejection head in Third Embodiment.

FIGS. 9(*a*) to 9(*j*) are sectional views for illustrating a production process of the entire liquid ejection head of this embodiment. In the production process, FIGS. 9(*a*) to 9(*h*) illustrate a method of patterning the substrate 5. In this embodiment, the patterning of the substrate 5 is effected through anodization.

First, the anodization will be described briefly below. The anodization is a method in which electrolysis is performed in a hydrogen fluoride solution by using a substrate to be subjected to patterning (e.g., a silicon (Si) substrate) as an anode electrode and the other metal plate (e.g., a platinum (Pt) substrate) as a cathode electrode.

In this embodiment, at the anode electrode which is the Si substrate, the following chemical reactions occur.

$$Si+2HF+2h^{+}\rightarrow SiF_2+2H^{+} \quad (1)$$

After the reaction (1), Si is finally changed to $H_2SiF_6$ through the following four reactions (2) to to be dissolved in the hydrogen fluoride solution.

$$2SiF_2 \rightarrow Si^* + SiF_4 \quad (2)$$

$$SiF_4 + 2HF \rightarrow H_2SiF_6 \quad (3)$$

$$Si^* + 2H_2O \rightarrow SiO_2 + 2H_2 \quad (4)$$

$$SiO_2 + 6HF \rightarrow H_2SiF_6 + 2H_2O \quad (5)$$

In the reaction (1), $h^+$ represents a hole and in the reactions (2) and (4), Si* represents amorphous silicon.

Of these chemical reactions (1) to (5), the reaction (4) is particularly slow. Accordingly, a method in which an St substrate with a portion intended to be subjected to the patterning is changed into silicon oxide ($SiO_2$) in advance is immersed in the hydrogen fluoride solution to form $H_2SiF_6$ only by the reaction (5) is effective. According to this method, the chemical reactions (1) to (4) are not required, so that the electrolysis as described above is also not required to be carried out. As a result, the patterning can be effected by only immersing the Si substrate in the hydrogen fluoride solution.

In this embodiment, as shown in FIG. 9(*g*), a method in which an Si substrate 5 with a portion, intended to be subjected to the patterning, which has been changed into the silicon oxide ($SiO_2$) in advance is prepared and immersed in the hydrogen fluoride solution to a structure as shown in FIG. 9(*h*) is considered.

First, as shown in FIG. 9(*a*), the substrate 5 for patterning is prepared. As the substrate 5, e.g., an Si substrate or an SOI substrate or the like is used. However, in either case, a p-type Si substrate or a p-type SOI substrate is required to be used. The substrate 5 is formed in a thickness of, e.g., about 200 μm. As shown in FIG. 5(*a*), on both surfaces of the substrate 5, e.g., a silicon nitride film 52 is formed and used as a mask for the patterning. In this state, the substrate 5 is heat-oxidized to form a silicon oxide layer 53 but the silicon nitride film 52 functions as the mask during the patterning. For this reason, the silicon portion covered with the silicon nitride film 52 is not oxidized. Thereafter, the silicon nitride film 52 is removed from the substrate 5 to form a structure shown in FIG. 9(*b*).

Next, as shown in FIG. 9(*c*), on the surface of the substrate 5 in a position where the common liquid chamber communicating path 18 is to be formed, a silicon oxide film 53 is formed by, e.g., an epitaxial growth method or the like. Thereafter, a polysilicon film 54 is laminated on the substrate 5 by, e.g., the epitaxial growth method or the like to create a state shown in FIG. 9(*d*). Then, the silicon nitride film 52 is laminated on the substrate 5 and subjected to the oxidization processing again. After the oxidization processing, the substrate 5 from which the silicon nitride film 52 is removed is shown in FIG. 9(*e*). Thereafter, the polysilicon film 54 is laminated in a thickness of, e.g., 200 μm on the substrate 5 again by the epitaxial growth method or the like to create a state shown in FIG. 9(*f*).

Next, the substrate 5 is subjected to patterning of the orifice communicating paths 17 and the common liquid chamber communicating paths 18*a*, 18*b* and 18*c*. This patterning is performed through, e.g., the chemical etching or the ion milling. However, with respect to the common liquid chamber communicating path 18*b*, the silicon oxide film 53 functions as a stopper (etching stopper film) for the patterning, so that the patterning does not progress toward a lower portion than the silicon oxide film 53. After the patterning, the substrate 5 is subjected to the flattening processing. The substrate 5 at this time is shown in FIG. 9(*g*).

Next, the substrate 5 is patterned. The patterning is performed in the hydrogen fluoride solution by immersing the substrate 5 in the solution. In FIG. 9(*h*), a shape of the substrate 5 after the patterning is shown.

FIGS. 9(*i*) and 9(*j*) show steps for completing the liquid ejection head by turning the substrate 5 subjected to the patterning in the steps shown in FIGS. 5(*a*) to 6(*h*) upside down and placing the substrate 5 between the substrates 1 and 4, followed by bonding of these substrates. First, as shown in FIG. 9(*i*), patterned substrates 1 and 4 are prepared. These substrates 1 and 4 are, e.g., the same as the patterned substrates used in First and Second Embodiments. Finally, as shown in FIG. 9(*j*), the bonding of the substrates 1, 5 and 4 is performed so that these substrates are laminated in this order. This bonding is effected through, e.g., gold (Au)-gold (Au) bonding. Through the above-described steps, the liquid ejection head of this embodiment is completed.

Fourth Embodiment

Figure 10:
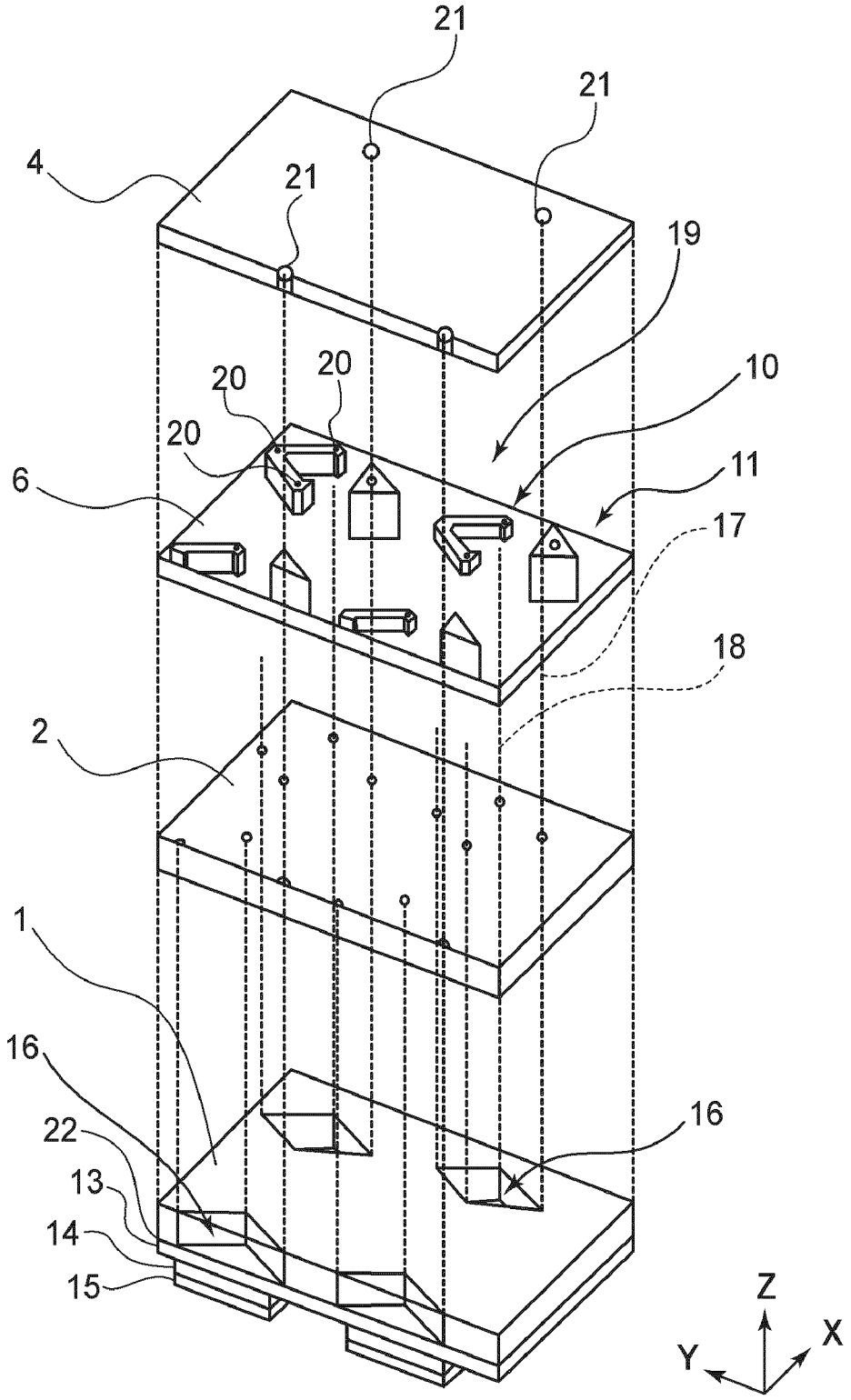
FIG. 10 is an exploded perspective view showing a liquid ejection head according to Fourth Embodiment of the present invention.

Fourth Embodiment will be described with reference to FIG. 10. FIG. 10 is an exploded perspective view of a liquid ejection head of this embodiment. As shown in FIG. 10, an orifice communicating path 17 in this embodiment is constituted by an orifice communicating path column-like portion 11 formed in a substantially triangular cross section. On side of the triangular cross-sectional orifice communicating path column-like portion 11 is disposed to face the space defined by the V cross-sectional common liquid chamber communicating path projected portion.

In this embodiment, the orifice communicating path column-like portion 11 is formed in the substantially triangular cross section, so that compared with First Embodiment employing the V cross-sectional orifice communicating path column-like portion, processing of the orifice communicating path column-like portion is easily performed. In addition, this embodiment has the advantage that positional deviation between a substrate 6 and a substrate 4 can be reduced when these substrates are bonded to each other.

As shown in FIG. 10, the liquid ejection head of this embodiment is constituted by bonding four substrates consisting of the substrates 1, 2, 6 and 4 similarly as in First Embodiment. However, in this embodiment, the substrate 6 is provided with the triangular cross-sectional orifice communicating path column-like portions 11. Similarly as in First Embodiment, in order to obtain a sufficient mechanical strength of the bonding between the substrates 2 and 6, the patterning of the substrate 6 may desirably be performed after the bonding between the substrates 2 and 6.

The liquid ejection head of this embodiment can be produced in the same manner as in First Embodiment described with reference to FIGS. 5(*a*) to 5(*f*). The description of the production process will be omitted.

Finally, a recording apparatus to which the liquid ejection heads of the respective embodiments described above are applicable will be described.

Figure 11:
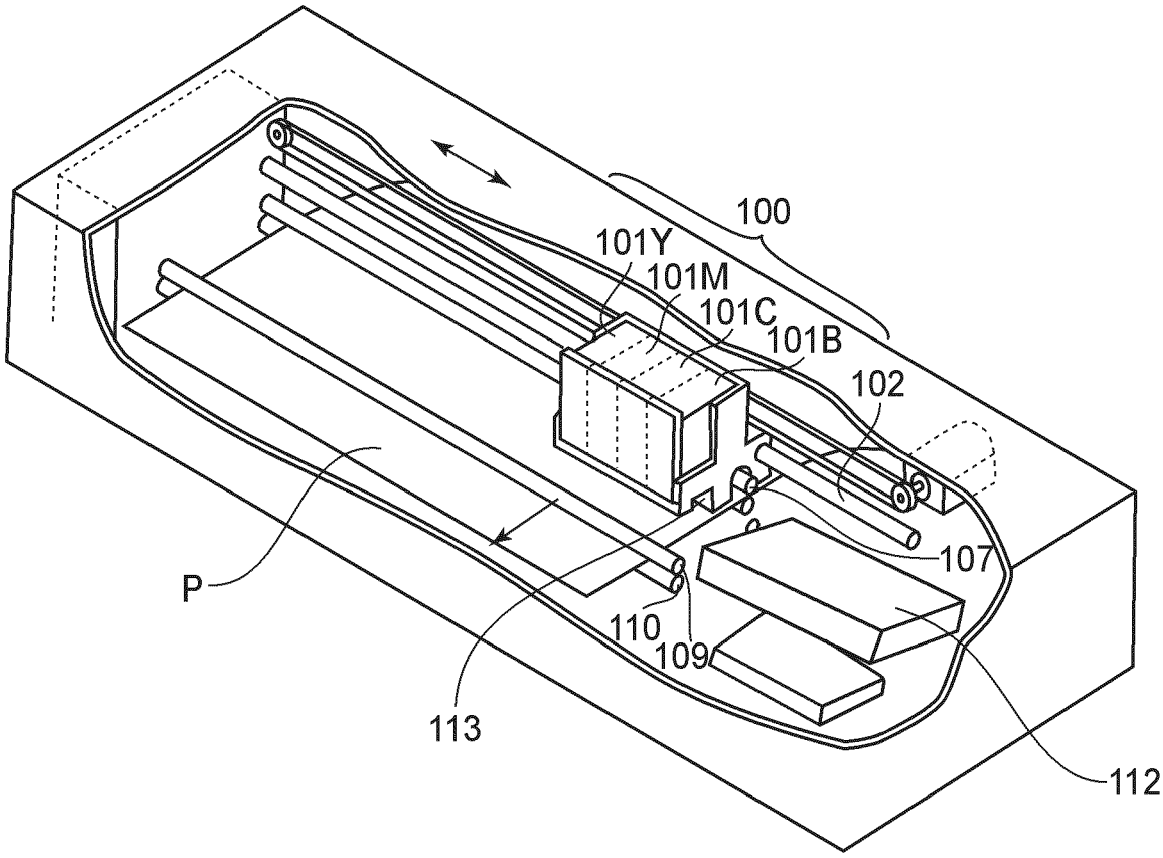
FIG. 11 is a perspective view showing a recording apparatus to which the above described liquid ejection heads are applicable.
Figure 12:
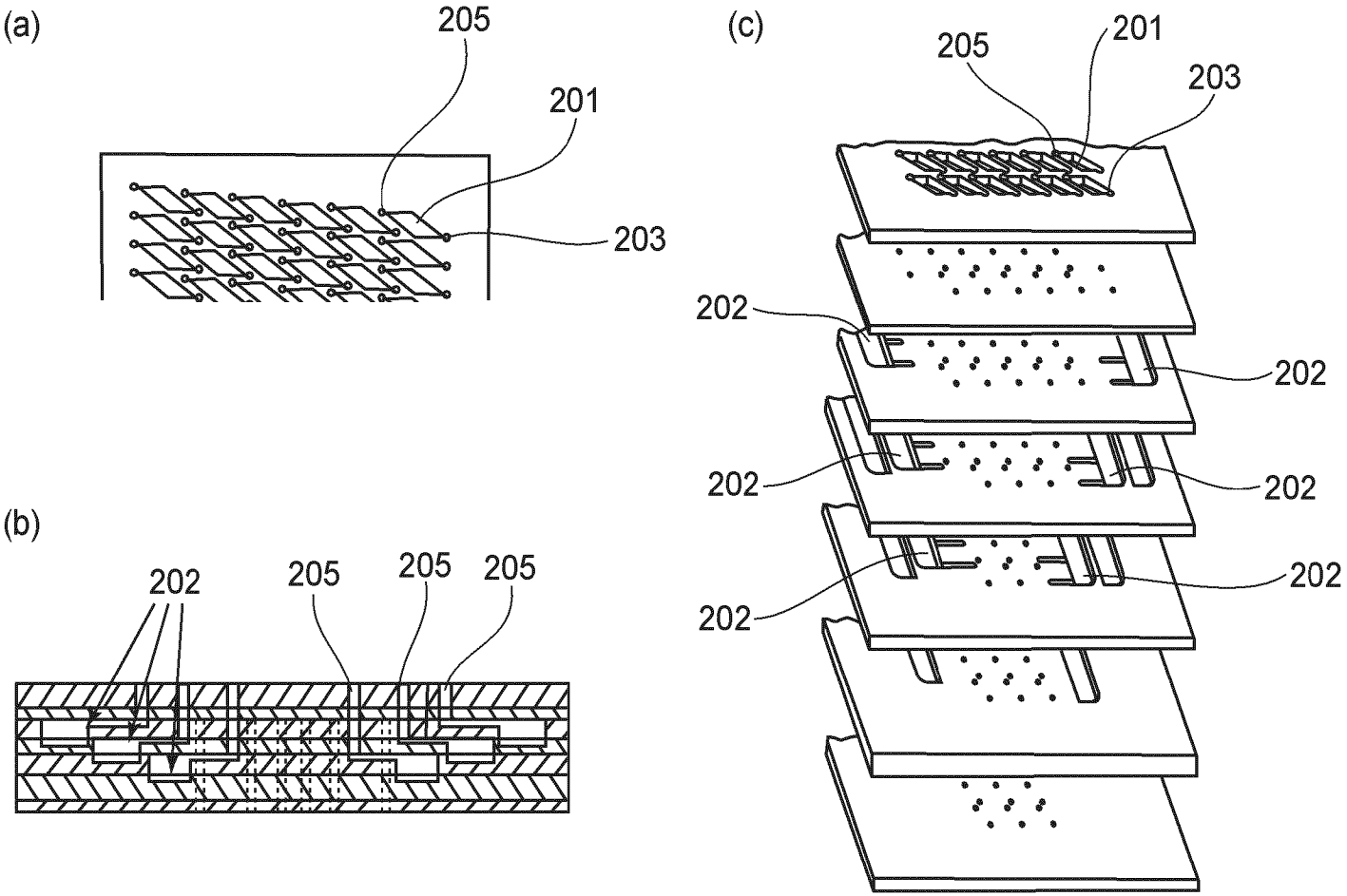
FIGS. 12(*a*) to 12(*c*), FIGS. 13(*a*) and 13(*b*), and FIGS. 14(*a*) to 14(*c*) are schematic views for illustrating conventional liquid ejection heads.
Figure 13:
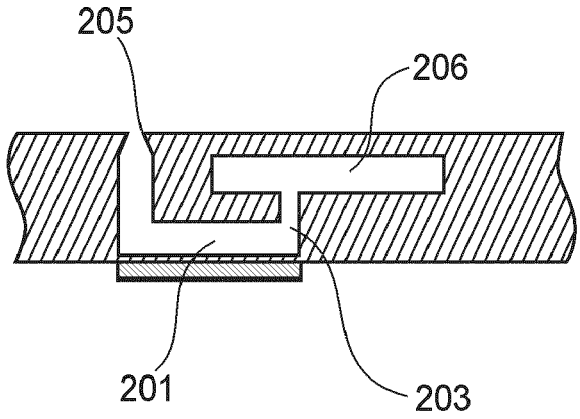
Figure 13:
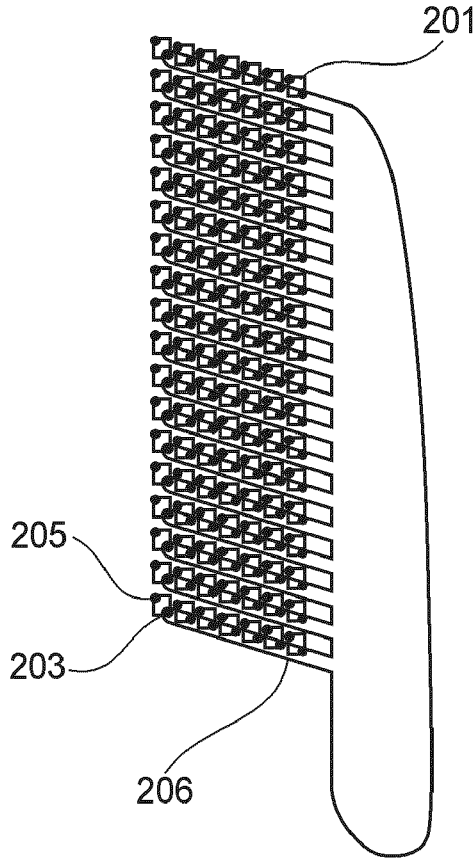
Figure 14:
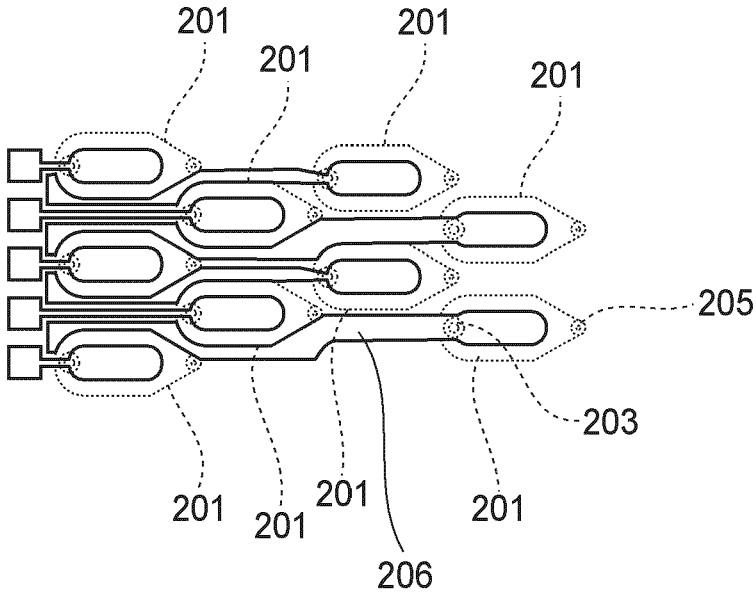
Figure 14:
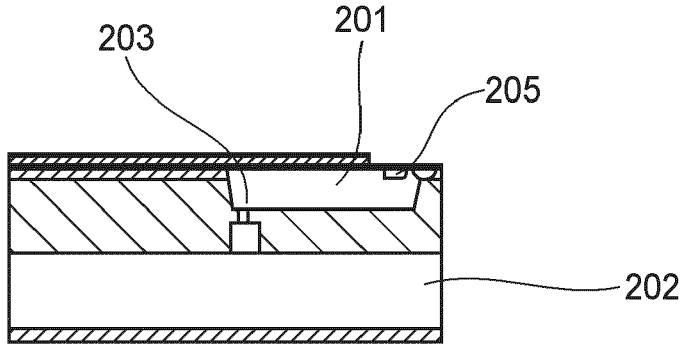
Figure 14:
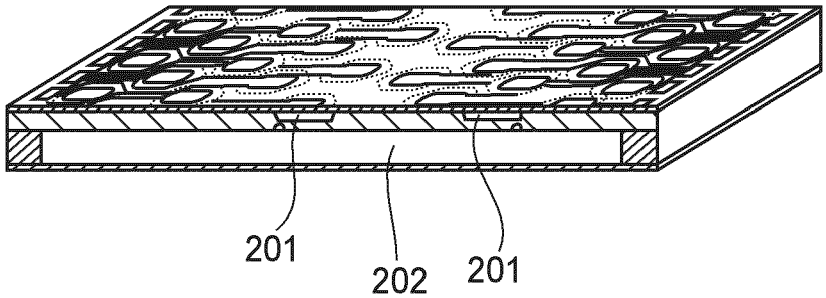

FIG. 11 is a perspective view showing a recording apparatus to which the present invention is applicable. A recording material P supplied to the recording apparatus is conveyed by a pair of conveying rollers 109 and 110 to an area in which recording can be made by a liquid ejection head unit 100. The liquid ejection head unit 100 is guided by a pair of guiding shafts 107 and 102, being enabled to be reciprocally moved along the guiding shafts 107 and 102 in the direction (main scan direction) parallel to the direction in which the guiding shafts 107 and 102 extend. The scan direction of the liquid ejection head unit 100 is the main scan direction, and the direction in which the recording material P is conveyed is a sub-scan direction. To the liquid ejection head unit 100, liquid ejection heads 113 shown in FIG. 2 (plan view) and a plurality of ink containers 101 for supplying inks to a common liquid chamber 19 are mounted. The ink containers 101 include ink containers 101B, 101C, 101M and 101Y of four colors of black (Bk), cyan (C), magenta (M), and yellow (Y) inks. A refreshing unit 112 for refreshing an ejection characteristic of the liquid ejection head 113 is disposed below a right end portion in a movable range of the liquid ejection head unit 100. The refreshing unit 112 refreshes the ejection characteristic, e.g., by forcely ejecting the ink(s) from the ejection outlets 21 of the liquid ejection head 113 during a non-recording operation.

In the recording apparatus of this embodiment, the ink containers 101B, 101C, 101M and 101Y of Bk, C, M and Y are structured so that the ink containers can be replaced independently from each other. In the liquid ejection head unit 100, the ink container 101B for Bk ink, the ink container 101C for C ink, the ink container 101M for M ink, and the ink container 101Y for Y ink, are mounted. To the ink containers 101B, 101C, 101M and 101Y, the liquid ejection heads are mounted, respectively, so that each of the inks is supplied to an associated common liquid chamber 19 of each of the liquid ejection heads.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 178286/2007 filed Jul. 6, 2007, which is hereby incorporated by reference.

What is claimed is:

1. An ink jet recording head comprising:

a plurality of ejection outlets for ejecting liquid;

individual liquid chambers communicating with said plurality of ejection outlets;

ejection energy generating elements, provided correspondingly to associated ones of said individual liquid chambers, for generating energy for ejecting the liquid;

a common liquid chamber for supplying the liquid to said plurality of individual liquid chambers; and communicating paths constituting flow paths for communicating associated ones of said individual liquid chambers and said common liquid chamber with each other, wherein at least adjacent ones of said flow paths have communicating positions, at different portions as seen in a direction perpendicular to a direction of ejection of the liquid through the ejection outlets, with said common liquid chamber.

2. A head according to claim 1, wherein said common liquid chamber communicates with an associated individual liquid chamber through an associated flow path extending upwardly from said common liquid chamber with respect to the vertical direction.

3. A head according to claim 1, wherein each of said individual liquid chambers communicates with an associated ejection outlet through an associated orifice communicating path extending downwardly from said individual liquid chamber with respect to the vertical direction.

4. A head according to claim 3, wherein each of said individual liquid chambers has a substantially rhombus cross-section with respect to a direction perpendicular to the vertical direction, and wherein each individual liquid chamber has a first corner portion at which a connecting portion with the associated flow path is disposed and a second corner portion at which a connecting portion with the orifice communicating path is disposed.

5. A head according to claim 1, wherein said flow paths have communicating positions including communicating positions identical in level to each other.

6. A head according to claim 1, wherein said common liquid chamber and said individual liquid chambers are connected by said flow paths.

7. A head according to claim 1, wherein each of said communicating paths is defined by a column-like portion disposed in said common liquid chamber.

8. A head according to claim 7, wherein the column-like portion has a substantially V-character shape cross-section with respect to a direction perpendicular to the vertical direction.

9. A head according to claim 7, further comprising a first substrate provided with said plurality of ejection outlets, a second substrate provided with the column-like portions, and a third substrate provided with said individual liquid chambers.

* * * * *